US008960847B2

(12) United States Patent
Hara et al.

(10) Patent No.: US 8,960,847 B2
(45) Date of Patent: Feb. 24, 2015

(54) LIQUID EJECTING APPARATUS HAVING A LIGHT SENSOR FOR DETECTING WHEN A RECORDING MEDIUM IS RAISED FROM A SUPPORT UNIT

(75) Inventors: Osamu Hara, Shiorjiri (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 13/567,885

(22) Filed: Aug. 6, 2012

(65) Prior Publication Data

US 2013/0044156 A1 Feb. 21, 2013

(30) Foreign Application Priority Data

Aug. 18, 2011 (JP) ..... 2011-178932

(51) Int. Cl.
*B41J 29/393* (2006.01)
*B41J 11/00* (2006.01)

(52) U.S. Cl.
CPC ..... *B41J 11/006* (2013.01); *B41J 11/0095* (2013.01)
USPC ..... 347/19

(58) Field of Classification Search
CPC ..... B41J 11/0095; B41J 11/006
USPC ..... 347/19, 16; 250/559.4
See application file for complete search history.

(56) References Cited

U.S. PATENT DOCUMENTS

2004/0233244 A1* 11/2004 Elgee et al. ..... 347/19
2011/0205279 A1* 8/2011 Shimizu ..... 347/16
2012/0153192 A1* 6/2012 Puigoriol et al. ..... 250/559.4

FOREIGN PATENT DOCUMENTS

CN 201863489 10/2010
JP 10-045297 2/1998
JP 2000-001012 1/2000
JP 2009-006482 1/2009

* cited by examiner

*Primary Examiner* — Julian Huffman
*Assistant Examiner* — Carlos A Martinez
(74) *Attorney, Agent, or Firm* — Workman Nydegger

(57) ABSTRACT

A liquid ejecting apparatus including: a liquid ejecting head configured to eject liquid to a target; a supporting unit configured to support the target; a light-detecting unit arranged so that a transporting route is located between the supporting unit and the light-detecting unit in a prescribed direction in which the supporting unit and the target supported by the supporting unit are arranged when the supporting unit supports the target, and including a light-emitting portion configured to emit light and a light-receiving portion configured to receive the light from the light-emitting portion; and a determining unit configured to determine whether or not at least part of a supported portion of the target supported by the supporting unit is separated from the supporting unit on the basis of the light-receiving quantity at the light-receiving portion.

5 Claims, 4 Drawing Sheets

LIQUID EJECTING APPARATUS HAVING A LIGHT SENSOR FOR DETECTING WHEN A RECORDING MEDIUM IS RAISED FROM A SUPPORT UNIT

This application claims priority to Japanese Patent Application No. 2011-178932 filed on Aug. 18, 2011. The entire disclosure of Japanese Patent Application No. 2011-178932 is hereby incorporated herein by reference.

BACKGROUND

1. Technical Field

The present invention relates to a liquid ejecting apparatus such as an ink jet printer.

2. Related Art

In general, as a printing apparatus having a detection system for detecting a jam of printing paper (also referred to as "paper jam") transported along a predetermined direction of transport, an apparatus in which a plurality of the detection systems are arranged along a transporting route for printing paper is known (see JP-A-2000-1012). The detecting systems described above include a light-emitting portion configured to emit light and a light-receiving portion configured to receive light, respectively. Then, one of the light-emitting portion and the light-receiving portion is arranged on a back surface (that is, a surface which is not subjected to printing) of the printing paper, and the other one of the light-emitting portion and the light-receiving portion is arranged on the side of a front surface (that is, a surface which is subjected to printing) of the printing paper.

When the printing paper is transported, time counting is started when a leading end of the printing paper is detected by a first detecting system from the plurality of detecting systems, which is located on the upstream side in the direction of transport. Then, when the leading end of the printing paper cannot be detected by the second detecting system located on the downstream side in the direction of transport even though elapsed time from when the leading edge of the printing paper is detected by the first detecting system exceeds a time reference value set on the basis of a transporting speed of the printing paper, it is determined that the paper jam occurs.

For reference, a method of detecting transport failures such as the paper jam using the plurality of the detecting systems arranged along the direction of transport is also applicable in liquid ejecting apparatus having a liquid ejecting head configured to eject liquid such as ink onto a target such as the printing paper (for example, an ink jet printer).

Incidentally, the liquid ejecting apparatus is generally provided with a supporting unit configured to support a target and a carriage as a moving body which moves in a predetermined scanning direction in a movable area set on the opposite side of the supporting with the target interposed therebetween, and the liquid ejecting head is provided on the carriage. In such a liquid ejecting apparatus, a portion of the target opposing the movable area (hereinafter, referred to also as a "supported portion") is supported by the supporting unit, and the supported portion is configured not to come into contact with the carriage or the liquid ejecting head mounted on the carriage.

However, when the transport failure of the target or the like occurs, there is a probability that the target cannot be adequately transported along the direction of transport, and at least part of the supported portion of the target may be separated from the supporting unit toward the carriage, that is, at least part of the supported portion is separated upward from the supporting unit. In such a case, there is a probability that the target comes into contact with the carriage moving in the scanning direction. When the movement of the carriage is continued without detecting such a contact, the target may become damaged due to the movement of the carriage in a state of being kept in contact with the target. Accordingly, when at least part of the supported portion of the target is separated from the supporting unit and the target and the carriage come into contact with each other, the contact is needed to be detected in an early stage.

When detecting the fact that at least part of the supported portion of the target is separated from the supporting unit using the method described in JP-A-2000-1012, a problem as shown below may occur. In other words, with the method described above, the respective detecting systems are arranged along the direction of transport of the target. In addition, the transport failure of the target is not detected unless time of a certain extent is elapsed since the detection of the leading end of the target by the first detecting system, the transport failure of the target is not detected. Therefore, there is a probability that the carriage moves in a state of being in contact with the target and hence the target becomes damaged or the degree of the damage is increased during a period from when the transport failure actually occurs until the transport failure is detected. The term "damage" used here includes unnecessary breaks of the target, or unnecessary folds of the target.

Also, separating of at least part of the supported portion of the target from the supporting unit may occur at the time other than the transport failure of the target represented by, so-called, the paper jam. For example, when the target is formed of a porous material having a liquid absorbing property in which pulp fibers (mainly composed of cellulose) made from wood constitute a mesh structure, the target absorbs ink solvent (organic solvent such as water content or alcohol) of adhered ink, and hence is swelled. Consequently, a cockling phenomenon that the target is deformed into a wavy form occurs, and at least part of the supported portion of the target may be separated from the supporting unit. In this case, separating of at least part of the supported portion of the target from the supporting unit does not cause any problem in transport of the target and hence cannot be detected with the method descried in JP-A-2000-1012.

The liquid ejecting apparatus is not limited to the type in which the liquid ejecting head is mounted on the moving body. For example, in the liquid ejecting apparatus of a type in which the liquid ejecting head is not mounted on the moving body, when the contact between the moving body and the target cannot be detected, the target may be subjected to a damage or increase in degree of the damage due to the movement of the movable member in a state in which the contact with the target is maintained in the same manner as the case of the liquid ejecting apparatus of the type in which the liquid ejecting head is mounted on the moving body.

SUMMARY

An advantage of some aspects of the invention is that there is provided a liquid ejecting apparatus which achieves improvement of determination accuracy whether or not a portion of a target supported by a supporting unit which is at least part of a supported portion opposing a movable area of a moving body is separated from the supporting unit.

According to a first aspect of the invention, there is provided a liquid ejecting apparatus including: a liquid ejecting head configured to eject liquid with respect to a target transported along a direction of transport; a supporting unit configured to support the target; a moving body configured to move forward and backward in a movable area set so that a transporting route for the target is located between the supporting unit and the movable area along the direction of scanning in a prescribed direction in which the supporting unit and the target supported by the supporting unit are arranged when the supporting unit supports the target; a light-detecting unit arranged so that the transporting route is located between the supporting unit and the light-detecting unit in the prescribed direction, and including a light-emitting portion configured to emit light and a light-receiving portion configured to receive light from the light-emitting portion; a determining unit configured to determine whether or not at least part of a supported portion of the target supported by the supporting unit is separated from the supporting unit on the basis of the light-receiving quantity at the light-receiving portion, wherein the light-emitting portion is arranged at a first position set on the outside of the supported portion of the target supported by the supporting unit in the width direction of the target or a second position set at one end in the scanning direction of the moving body, and the light-emitting portion arranged at one of the first and second positions emits light toward the other one of the first and second positions.

In this configuration, the light-emitting portion arranged at one of the first and second positions emits light toward the other one of the first and second positions. The light from the light-emitting portion as described above is received by the light-receiving portion when the entire part of the supported portion of the target is in contact with the supporting unit, it is determined that the supported portion of the target is not separated from the supported portion of the target. In contrast, in a case where at least part of the supported portion of the target is separated from the supported unit, if a region of the supported portion separated from the supporting unit (hereinafter, referred to as a "separated region") is located between the first position and the second position, the light from the light-emitting portion is blocked or changed in direction of travel by the separated region. Consequently, the light-receiving quantity at the light-receiving portion is lowered, and it is determined that the separated region is generated in the target. In other words, the fact that the separated region is generated may be determined even in a case where the separated region is generated in the supported portion of the target at the time other than the transport failure of the target, Therefore, accuracy of determination of whether or not at least part of a target supported by a supporting unit and opposing a movable area of a moving body is separated from the supporting unit is improved.

Preferably, the first position is set to a position at which the scanning direction of the moving body and the direction of travel of the light emitted from the light-emitting portion intersect.

When the direction of travel of the light from the light-emitting portion matches the scanning direction of the moving body, erroneous determination that the separated region is not generated may occur in the state shown below even when the separated region is generated in the supported portion of the target. For example, there is a case where a plurality of different regions of the supported portion in the direction of transport (also referred to as "supported region") are supported by the supporting unit, while portion between the supported portions adjacent in the direction of transport may separate upward from the supporting unit. In this case, the region located between the supported portions supported by the supporting unit and also separated from the supporting unit corresponds to the separated region. In this case, the light from the light-emitting portion may pass through the interior of the gaps formed between the separated region of the supported portion and the supporting unit without entering the separated region generated in the target. Consequently, the light from the light-receiving portion is received by the light-receiving portion without being disturbed by the target. As a result, even when the separated regions are actually generated in the supported portion of the target, the separated region is not detected by using the light-detecting unit.

At this point, in the invention, the direction of travel of the light from the light-emitting portion intersects the scanning direction of the moving body. Therefore, the probability that the light from the light-emitting portion enters the separated region of the supported portion is higher than the case where the direction of travel of the light from the light-emitting portion matches the scanning direction of the moving body. Consequently, accuracy of the determination of whether or not the separated regions are generated in the supported portion of the target is improved.

Preferably, a reference position of the moving body is set to one side with respect to the supported portion of the target supported by the supporting unit in the width direction of the target, and the first position is set to the other side with respect to the supported portion of the target in the width direction of the target, and the determining unit determines whether or not at least part of the supported portion of the target is separated from the supporting unit on the basis of the light-receiving quantity at the light-receiving portion in one of cases where the moving body is located at the reference position, and where the moving body moves in the direction away from the reference position.

In this configuration, when performing a determining process in a state in which the moving body is located at a reference position, the existence of the separated regions in the supported portion of the target is determined before starting the movement from the reference position of the moving body. When the determining process is performed in a state in which the moving body moves from the reference position, whether or not the separated region exists is determined before the moving body during the movement comes into contact with the target, or whether or not the separated region exists is determined quickly after the contact. Therefore, when it is configured to prohibit the movement of the moving body when it is determined that the separated regions exist, the contact between the moving body and the target may be avoided, or the degree of breakage of the target in association with the contact between the moving body and the target may be minimized.

Preferably, a moved amount detecting unit configured to detect the moved mount of the moving body in the scanning direction with reference to the reference position is provided and when the moved amount detected by the moved amount detecting unit is equal to or lower than a moved amount reference value set in advance, the determining unit determines whether or not at least part of the supported portion is separated from the supporting unit on the basis of the light-receiving quantity at the light-receiving portion.

In the case of the configuration in which the direction of travel of the light from the light-emitting portion intersects the scanning direction of the moving body, there may be a case where the light from the light-emitting portion cannot be received by the light-emitting portion even when the separated region does not exist in the supported portion. Accordingly, in the invention, when the moved amount of the moving body detected by the moved amount detecting unit is equal to or smaller than the moved amount reference value, whether or not the separated region is generated in the supported portion of the target is determined depending on the light-receiving quantity at the light-receiving portion. In other words, when the moving body is located at a position which allows the light receiving quantity at the light-receiving portion to be changed depending on whether or not the separated region exists between the first and second positions.

Preferably, a reflecting portion provided on any one of the first and second positions and configured to reflect the light from the light-emitting portion is further provided, and the light-receiving portion is capable of receiving the reflected light from the reflecting portion when the moved amount detected by the moved amount detecting unit is equal to or lower than the moved amount reference value.

In this configuration, when the moved amount from the reference position of the moving body is equal to or smaller than the moved amount reference value, whether or not the separated region is generated in the supported portion of the target depending on the light-receiving quantity at the light-receiving portion even in a configuration in which the light from the light-emitting portion is caused to be received by the light-receiving portion via the reflecting portion.

Preferably, the liquid ejecting head is provided on the moving body, and the light-emitting portion is arranged at the first position, and the first position is set on the downstream side with respect to the second position in the direction of transport.

In this configuration, whether or not the separated region is generated in a portion of the supported portion of the target where the liquid is adhered can be determined with high degree of accuracy in comparison with the case where the first position is set to the upstream side with respect to the second position in the direction of transport.

Preferably, the liquid ejecting head is provided on the moving body, and the light-emitting portion is arranged at the first position, and the light-emitting portion is arranged so that the light travels toward a predetermined position of the moving body located at the reference position or the upstream side with respect to the predetermined position thereof in the direction of transport, and the predetermined position is set at the same position in the direction of transport as a center in the direction of transport of the liquid ejecting head.

When the direction of travel of the light is set on the basis of a case where the liquid ejecting head is located at a position close to the first position, there is a probability that the fact that the separated regions exist in the target cannot be detected when the liquid ejecting head is located at a position close to the reference position. In this case, when the separated region actually exists in the target, there may arise a time lag from the start of the actual contact between the moving body approaching from the reference position to the first position and the target until when the contact can be detected on the basis of the light-receiving quantity at the light-receiving portion. The longer such a time lag, the larger the probability that the degree of breakage of the target is increased in association with the contact between the moving body and the targets.

According to the invention, however, the direction of travel of light is set on the basis the position where a liquid ejecting head is located at the reference position farther from the first position. Therefore, in comparison with the case where the direction of travel of the light is set on the basis of a case where the liquid ejecting head is located at a position close to the first position, the existence of the separated region in the target can be detected when the liquid ejecting head is at the reference position or when the liquid ejecting head is still far from the first position. In other words, when the separated region exists in the supported portion of the target, the separated region may be detected in an early stage.

BRIEF DESCRIPTION OF THE DRAWINGS

The invention will be described with reference to the accompanying drawings wherein like numbers reference like elements.

DESCRIPTION OF EXEMPLARY EMBODIMENTS

Referring now to FIG. 1 to FIG. 6, an embodiment in which the invention is embodied will be described. In the following description of this specification, "front and back directions", "up and down directions", and "left and right directions" indicate "front and back directions", "up and down directions", and "left and right directions" indicated by arrows in FIG. 1, FIG. 2 and FIG. 3, respectively.

Figure 1:
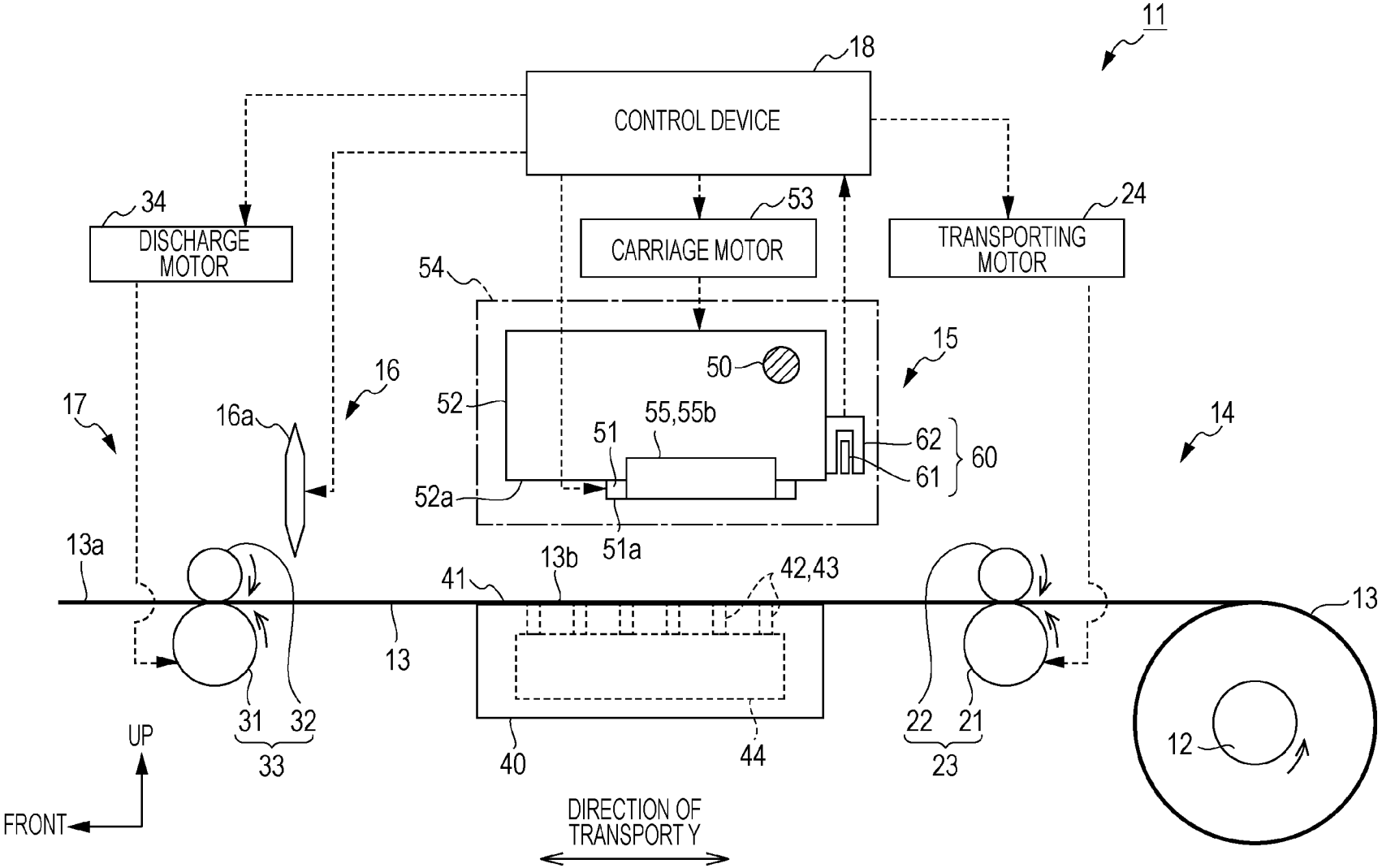
FIG. 1 is a side view showing a schematic configuration of an ink jet printer as an embodiment of a liquid ejecting apparatus according to the invention.

As shown in FIG. 1, an ink jet printer 11 as an example of a liquid ejecting apparatus is an apparatus configured to form an image on a roll paper 13 wound around a revolving shaft 12 extending in the lateral direction as a direction orthogonal to a paper plane into a roll form as an example of a target by adhering ink as an example of liquid on the roll paper 13. The ink jet printer 11 in this configuration includes a transporting portion 14 configured to transport the roll paper 13 fed by the rotation of the revolving shaft 12 around which the roll paper 13 is wound counterclockwise along a direction of transport Y (the fore-and-aft direction, in this case), and an ink ejecting unit 15 configured to adhere ink on the roll paper 13 transported by the transporting portion 14. Provided on the downstream side (left side in FIG. 1) of the ink ejecting unit 15 in the direction of transport Y is a cutting unit 16 having a cutter 16*a* for cutting the roll paper 13 and a discharge portion 17 configured to discharge a cut paper 13*a* cut off from the roll paper 13 by the cutting unit 16 toward a paper discharge tray, not shown. Then, the transporting portion 14, the ink ejecting unit 15, the cutting unit 16, and the discharge portion 17 are controlled by a control device 18.

Referring now to FIG. 1, the transporting portion 14 will be described.

As shown in FIG. 1, the transporting portion 14 has a configuration in which a plurality of (only one pair is shown in FIG. 1) pairs of rollers 23 each including a drive roller 21 and a driven roller 22 arranged so as to pinch the roll paper 13 are arranged along the direction of transport Y of the roll paper 13. The pair of rollers 23 transport the roll paper 13 toward the downstream (left side in FIG. 1) in the direction of transport Y by transmitting a drive force from a transporting motor 24 to the drive rollers 21. Although not illustrated in FIG. 1, at least a pair of rollers may be arranged between the ink ejecting unit 15 and the cutting unit 16 in the direction of transport Y.

Referring now to FIG. 1, the discharge portion 17 will be described.

As shown in FIG. 1, the discharge portion 17 includes a pair of rollers 33 including a drive roller 31 and a driven roller 32 arranged so as to pinch the cut paper 13*a*. The pair of rollers 33 discharge the cut paper 13*a* toward the paper discharge tray (not shown) by a drive force from a discharge motor 34 transmitted to the drive roller 31.

Figure 2:
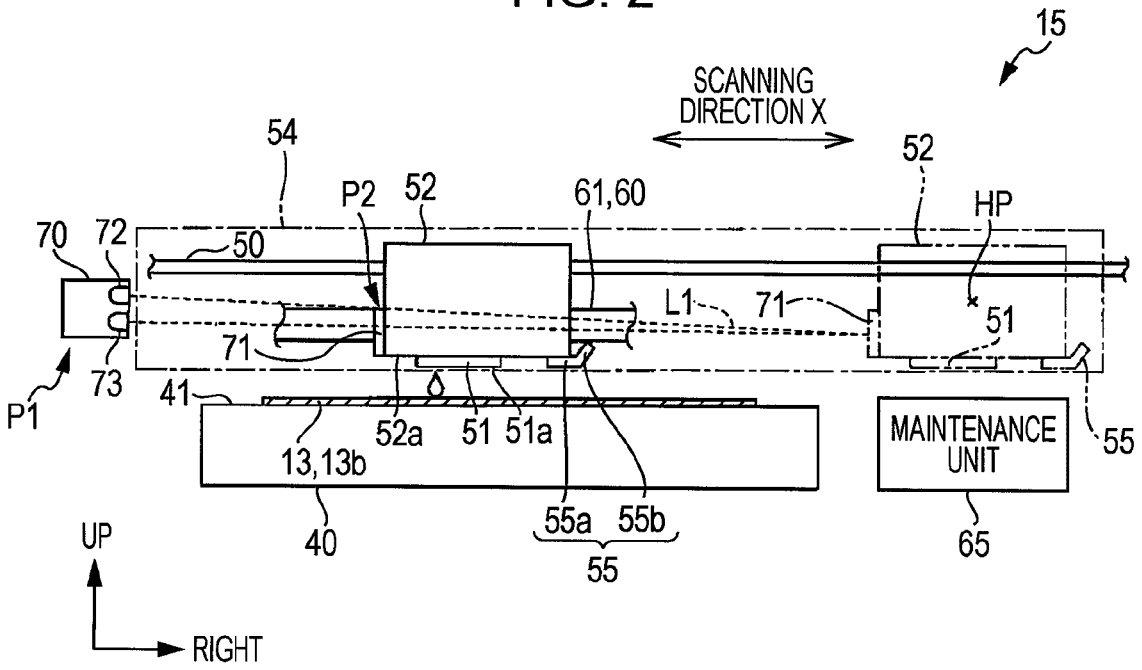
FIG. 2 is a front view showing an ink ejecting portion.
Figure 3:
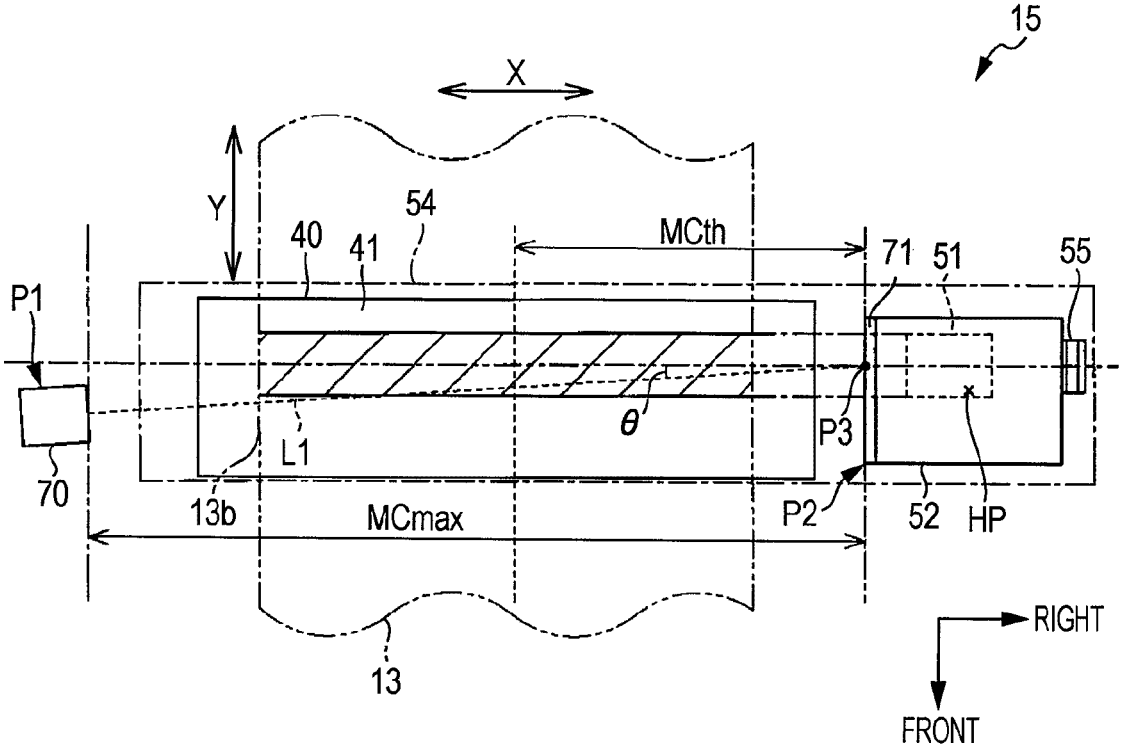
FIG. 3 is a plan view showing the ink ejecting portion.

Referring now to FIG. 1, FIG. 2, and FIG. 3, the ink ejecting unit 15 will be described.

As shown in FIG. 1 and FIG. 2, the ink ejecting unit 15 of the embodiment includes a supporting base 40 as an example of the supporting unit arranged on the underside of the transporting route for the roll paper 13 and configured to support a portion of the roll paper 13 transported to the ink ejecting unit 15. An upper surface of the supporting base 40 corresponds to a supporting surface 41 configured to support the roll paper 13. In the description given below, a portion of the roll paper 13 supported by the supporting surface 41 is referred to as a "supported portion 13*b*".

A plurality of sucking holes 42 are opened on the supporting surface 41 of the supporting base 40. Specifically, the supporting surface 41 is provided with a plurality of sucking hole rows 43 including the plurality of sucking holes 42 arranged equidistantly along a scanning direction X substantially orthogonal to the direction of transport Y are arranged along the direction of transport Y. Also, in the supporting base 40, a sucking mechanism 44 (for example, a sucking fan) configured to suck the supported portion 13*b* of the roll paper 13 beyond the respective sucking holes 42 is provided. Therefore, the supported portion 13*b* of the roll paper 13 is adsorbed on the supporting surface 41 by a suction force from the sucking mechanism 44.

A guide shaft 50 extending in the scanning direction X is provided on the side opposite the supporting base 40 by the intermediary of the transporting route for the roll paper 13, that is, on an upper area of the supporting base 40. In other words, the guide shaft 50 is arranged in an area where the transporting route for the roll paper 13 is located between the guide shaft 50 and the supporting base 40 in the vertical direction in which the supporting base 40 and the supported portion 13*b* supported by the supporting base 40 are arranged (a prescribed direction). A left end of the guide shaft 50 as described above is located on the left side of a left end of the supporting base 40 and a right end of the guide shaft 50 is located on a right side of right end of the supporting base 40. Also, the guide shaft 50 supports a carriage 52 as an example of the moving body provided with a recording head 51 as an example of the liquid ejecting head on a lower portion (opposed portion opposing the supporting base 40) 52*a* so as to be capable of moving forward and backward in the scanning direction X. The carriage 52 moves forward and backward along the scanning direction X in a movable area 54 set above the transporting route while being guided by the guide shaft 50 by the drive force from a carriage motor 53 transmitted via a power transmitting mechanism, not shown.

The recording head 51 is provided with a plurality of nozzles (not shown) configured to eject ink supplied from an ink storage, not shown, downward. These nozzles are opened on a nozzle formed surface 51*a* of the recording head 51 opposing the supporting base 40. The nozzle formed surface 51*a* is formed with a plurality of nozzle rows (not shown) including a plurality of nozzle openings arranged along the direction of transport Y, and the nozzle rows are arranged in the scanning direction X. Then, centers of the respective nozzle rows substantially match a center of the nozzle formed surface 51*a* in the direction of transport Y.

Also, provided on the lower portion 52*a* of the carriage 52 on the right side of the recording head recording head 51 is a holding portion 55 configured to press the region of the supported portion 13*b* of the roll paper 13 separated from the supporting surface 41 toward the carriage 52 (hereinafter, referred to as "separated region") against the supporting surface 41. The holding portion 55 includes a supported region 55*a* supported by the lower portion 52*a* of the carriage 52 and a inclined region 55*b* extending obliquely rightward and upward from a right end of the supported region 55*a*. In a case where the carriage 52 moves rightward, when there exists a separated region of the supported portion 13*b* of the roll paper 13, the holding portion 55 presses the separated region coming into contact with the holding portion 55 (specifically, the inclined region 55*b*) against the supporting surface 41. When the supported portion 13*b* of the roll paper 13 is not separated entirely from the supporting surface 41, the supported portion 13*b* does not come into contact with the holding portion 55.

Provided on the rear side of the carriage 52 is a linear encoder 60 as an example of the moved amount detecting unit configured to detect the moved amount of the carriage 52 from the home position HP as an example of the reference position set on the right side of the supporting base 40 (that is, a position of the carriage 52 in the scanning direction X with reference to the home position HP). The linear encoder 60 includes a detected tape 61 formed with slits, not shown, equidistantly along the scanning direction X and a detecting unit 62 provided on a rear portion of the carriage 52. Then, a pulsed detection signal corresponding to a moved distance of the carriage 52 is output from a sensor (not shown) provided on the detecting unit 62 to the control device 18.

As shown in FIG. 2 and FIG. 3, the home position HP is set to one side of the roll paper 13 in the width direction (the direction orthogonal to the direction of transport Y and the lateral direction) with respect to the supported portion 13*b* of the roll paper 13. Provided below the home position HP is a maintenance unit 65 for maintaining the recording head 51 when the carriage 52 is moved to the home position HP. Examples of the maintenance performed by the maintenance unit 65 includes wiping off the nozzle formed surface 51*a* of the recording head 51, flushing of the recording head 51, and cleaning of the recording head 51.

The carriage 52 is located at the home position before ejection of the ink onto the supported portion 13*b* of the roll paper 13. When ejecting ink onto the supported portion 13*b*, the carriage 52 moves from the home position toward the other end (leftward) in the scanning direction X, and during this period, the ink is ejected as needed from the recording head 51.

The ink ejecting unit 15 of the embodiment is provided with a photoelectric sensor 70 as an example of the light-detecting unit for detecting the separated region when the separated region is generated in the supported portion 13*b* of the roll paper 13 and a reflector 71 as an example of a reflecting portion. The reflector 71 reflects light so that an outgoing angle becomes the substantially same angle as an incident angle when the incident angle of light entering the reflector 71 is equal to or smaller than a predetermined angle. The reflector 71 as described above is arranged at a second position P2 set to a left end portion (one end portion in the scanning direction X) of the carriage 52.

The width of the reflector 71 (that is, the length in the fore-and-aft direction) matches the length of the carriage 52 in the fore-and-aft direction and the height of the reflector 71 (that is, the length in the up and down direction) is equal to or shorter than the length of the carriage 52 in the vertical direction. In the embodiment, the lower end of the reflector 71 matches a lower end of the carriage 52 in the vertical direction.

The photoelectric sensor 70 is a photoelectric sensor of a regressive reflection type, and includes a light-emitting portion 72 configured to emit vertical wave light toward the reflector 71 and a light-receiving portion 73 configured to receive the reflective light from the reflector 71. The vertical wave light or the light-emitting portion 72 is converted into a lateral wave when being reflected from the reflector 71 and emitted from the reflector 71. In other words, the reflected light from the reflector 71 entering the light-receiving portion 73 is lateral wave light. Then, a detection signal according to the quantity of received lateral wave light is output from the light-receiving portion 73 to the control device 18. In the embodiment, a line extending at a center of a light flux from the light-emitting portion 72 along the direction of travel of light emitted from the light-emitting portion 72 (hereinafter, referred to as a "light beam direction") is referred to as a "light beam L1".

The photoelectric sensor 70 is arranged is arranged at a first position P1 set on the outside of the movable area 54 set so that the transporting route for the roll paper 13 is located between the supporting base 40 and the photoelectric sensor 70 in the vertical direction (the prescribed direction) and on one side with respect to the roll paper 13 in the width direction. In the embodiment, the first position P1 is located on the upper side of the second position P2 where the reflector 71 is arranged, and on the downstream side (the front side) in the direction of transport Y with respect to the second position P2. In other words, the photoelectric sensor 70 is arranged on the upper side of the supported portion 13*b* supported by the supporting base 40.

The light-emitting portion 72 of the photoelectric sensor 70 arranged at the first position P1 emits light traversing the roll paper 13 in an area above the supported portion 13*b* of the roll paper 13. The light beam direction of the light emitted from the light-emitting portion 72 in this manner is different from the scanning direction X of the carriage 52 by a predetermined angle difference θ (≠0 (zero)°). Then, when light is emitted from the light-emitting portion 72 in a state in which the carriage 52 is at located the home position HP, the light beam L1 enters the reflector 71 at a predetermined position P3 set at the same position in the fore-and-aft direction as the center in the fore-and-aft direction of the recording head 51. Then, the light reflected from the 71 traverses the roll paper 13 in the area above the supported portion 13*b* of the roll paper 13 and then is received by the light-receiving portion 73 of the photoelectric sensor 70.

In this configuration, when the moved amount of the carriage 52 in the scanning direction with reference to the home position HP is equal to or smaller than an moved amount reference value MCth, at least part of the light emitted from the light-emitting portion 72 and reflected from the reflector 71 enters the light-receiving portion 73. In contrast, when the moved amount of the carriage 52 with reference to the home position HP exceeds the moved amount reference value MCth, light emitted from the light-emitting portion 72 does not enter or little enter the light-receiving portion 73. It is because the incident quantity of light to the reflector 71 is reduced or light from the light-emitting portion 72 does not enter the reflector 71 due to decrease in distance between the light-emitting portion 72 and the reflector 71.

In the embodiment, the above-described predetermined angular difference θ is set to an angle at which the moved amount reference value MCth becomes a value smaller than a distance MCmax from the home position HP to the first position P1. As an example, the predetermined angular difference θ is set to an angle at which the moved amount reference value MCth becomes a value on the order of half the distance MCmax.

Figure 4:
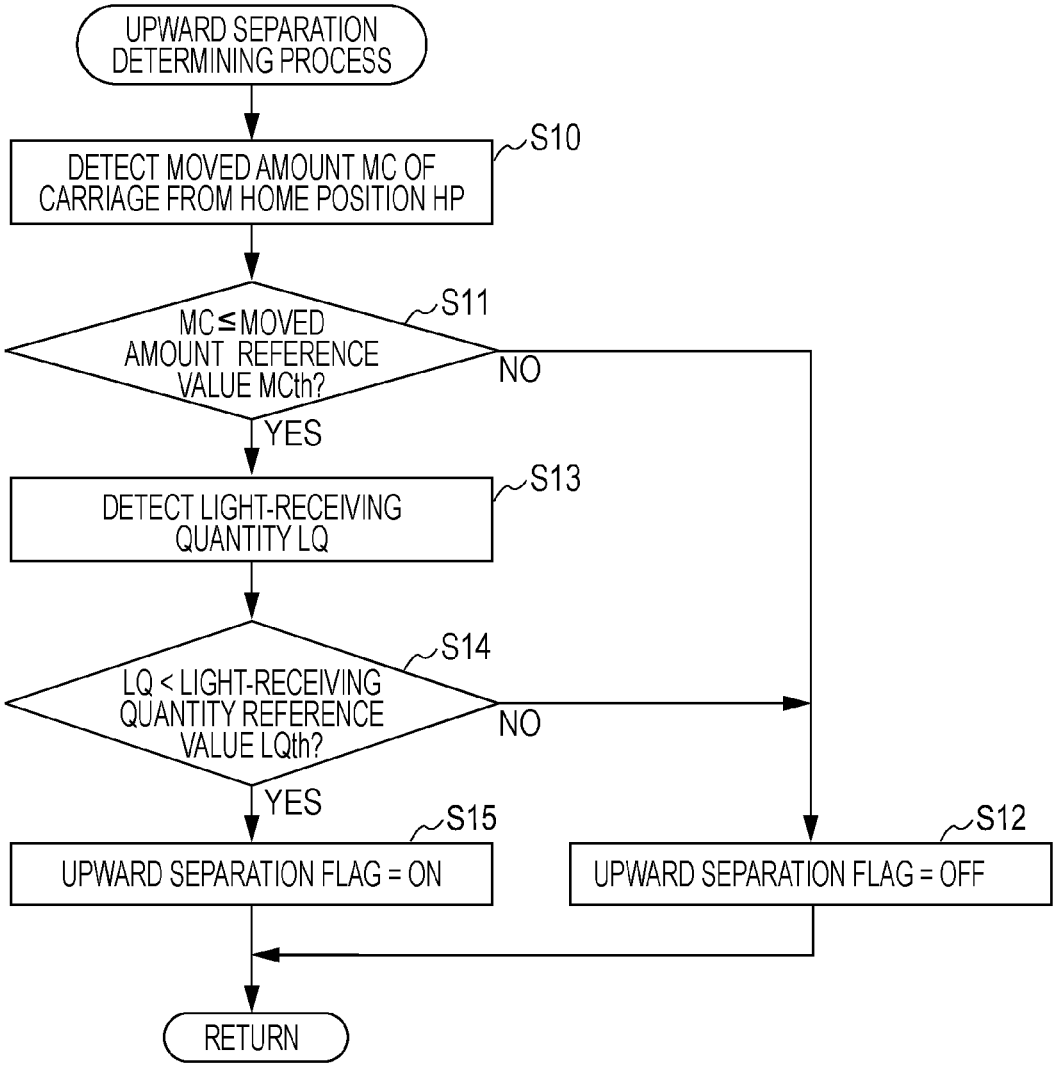
FIG. 4 is a flowchart explaining an upward separation determination process routine.

Subsequently, an upward separation determination process routine executed by the control device 18 of the embodiment will be described with reference to a flowchart shown in FIG. 4. In the embodiment, the expression "at least part of the supported portion 13*b* of the roll paper 13 is separated from the supporting surface 41, that is, the separated region is generated" is also expressed as "at least part of the supported portion 13*b* is separated upward from the supporting surface 41".

The upward separation determination process routine is executed at every predetermined intervals set in advance when the carriage 52 moves to one direction (leftward) in the scanning direction X, that is, when the carriage 52 moves in the direction away from the home position HP. In other words, the upward separation determination process routine is not executed when the carriage 52 moves in the other direction (rightward) in the scanning direction X.

In the upward separation determination process routine as described above, the control device 18 detects a moved amount MC of the carriage 52 from the home position HP on the basis of the detection signal input from the linear encoder 60 (Step S10). Subsequently, the control device 18 determines whether or not the detected moved amount MC is equal to or smaller than the moved amount reference value MCth (Step S11).

When the moved amount MC exceeds the moved amount reference value MCth (No in Step S11), the control device 18 determines that the photoelectric sensor 70 cannot be used for determination of whether or not the separated region is generated in the supported portion 13*b* of the roll paper 13. Then, the control device 18 sets an upward separation flag to OFF (Step S12), and ends the upward separation determination process routine once. The upward separation flag is a flag set to "ON" when the separated region is generated in the supported portion 13*b* of the roll paper 13 and, in contrast, set to "OFF" when the separated region is not generated and when the determination of whether or not the separated region is generated is impossible.

In contrast, when the moved amount MC is equal to or smaller than the moved amount reference value MCth (Yes in Step S11), the control device 18 detects a light-receiving quantity LQ at the light-receiving portion 73 of the photoelectric sensor 70 (Step S13). Subsequently, the control device 18 determines whether or not the detected light-receiving quantity LQ is smaller than a light-receiving quantity reference value LQth set in advance (Step S14). The light-receiving quantity reference value LQth is a value set as a determination reference for determining whether or not the light from the light-emitting portion 72 is blocked or is changed in direction of travel of light by a separated region generated in the supported portion 13*b* of the roll paper 13. In other words, in Step S14, whether or not the separated region is generated in the supported portion 13*b* of the roll paper 13 is determined by the light-receiving quantity LQ of the light-receiving portion 73. Therefore, in the embodiment, the control device 18 functions as a determination unit.

When the light-receiving quantity LQ is equal to or larger than the light-receiving quantity reference value LQth (No in Step S14), the control device 18 determines that the separated region is not generated in the supported portion 13*b* of the roll paper 13 and the procedure goes to Step S12 described above. In contrast, when the light-receiving quantity LQ is smaller than the light-receiving quantity reference value LQth (Yes in Step S14), the control device 18 determines that the separated region is generated in the supported portion 13*b* of the roll paper 13 and sets the upward separation flag to ON (Step S15). Subsequently, the control device 18 ends the upward separation determination process routine once.

Figure 5:
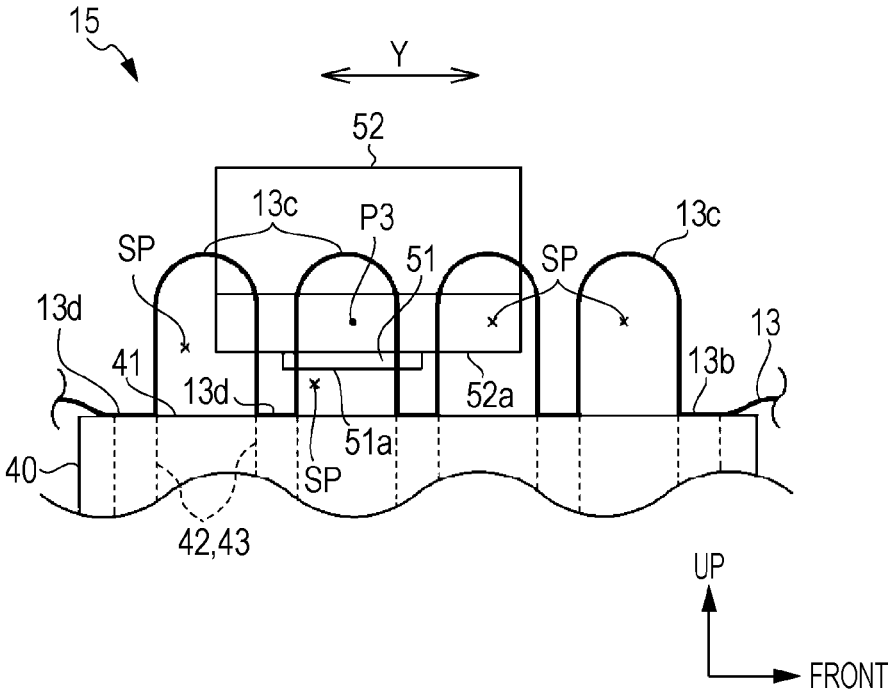
FIG. 5 is a schematic drawing showing a state in which part of a supported portion of a roll paper is separated from a supporting base.
Figure 6:
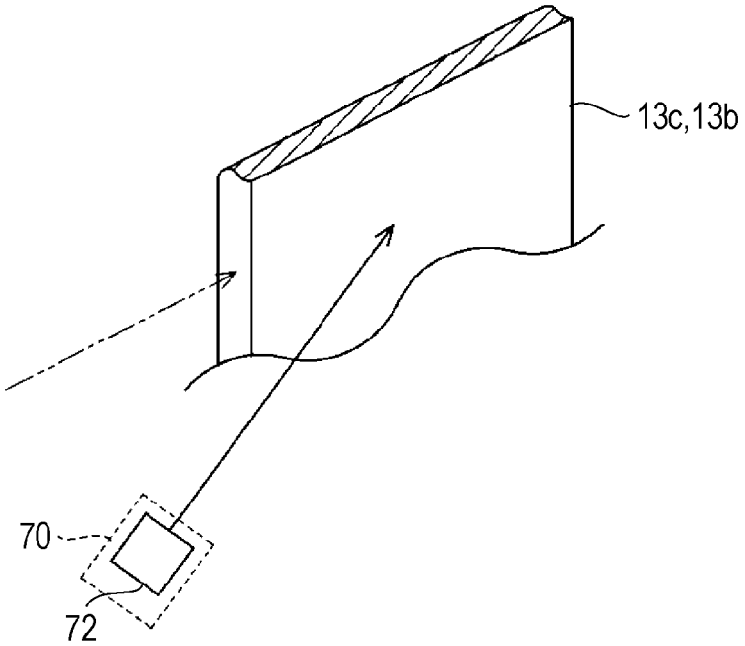
FIG. 6 is a schematic drawing showing a state in which light obliquely from a light-emitting portion enters a separated region generated in the supported portion of the roll paper.

Referring now to FIG. 5 and FIG. 6, an operation at the ink ejecting unit 15 of the embodiment will be described. It is assumed that part of the supported portion 13*b* of the roll paper 13 is a "separated region 13*c*" separated from the supporting surface 41 as a premise.

For example, when a transport failure such as a paper jam is generated on the downstream side (the right side in FIG. 5) in the direction of transport Y with respect to the ink ejecting unit 15, the separated region 13*c* is generated in the supported portion 13*b* of the roll paper 13 on the supporting base 40 as shown in FIG. 5. The plurality of sucking hole rows 43 extending in the scanning direction X (the direction orthogonal to the paper plane in FIG. 5) are arranged along the direction of transport Y on the supporting base 40 of the embodiment. Therefore, regions of the supported portion 13*b* of the roll paper 13 arranged at the same position as the sucking hole rows 43 in the direction of transport Y (hereinafter, referred to as "adsorbed regions 13*d*") is adsorbed to the supporting surface 41 by a suction force from the sucking mechanism 44. In contrast, the separated regions 13*c* are generated between the adsorbed regions 13*d* in the direction of transport Y, respectively.

The separated regions 13*c* as described above have upper ends thereof located on the upper side (more specifically, the upper side of an upper end of the reflector 71) than the lower portion 52*a* of the carriage 52. In addition, if the amount of deflection of the roll paper 13 on the supporting base 40 is large, regions substantially orthogonal to the supporting surface 41 may be included in the separated regions 13*c*.

In this case, if the photoelectric sensor 70 is arranged so that the predetermined angle difference θ0 via becomes "0 (zero)°", light from the light-emitting portion 72 of the photoelectric sensor 70 may pass through spaces SP between the supporting surface 41 and the separated regions 13*c* and reflected by the reflector 71, and then passes again through the spaces SP, and may be received by the light-receiving portion 73. Then, the light-receiving quantity LQ at the light-receiving portion 73 becomes equal to or larger than the light-receiving quantity reference value LQth and erroneous determination that the separated regions 13*c* are not generated may occur even though the separated regions 13*c* are generated in the supported portion 13*b* of the roll paper 13.

Depending on the positions of the sucking hole rows 43, the separated regions 13*c* may be located on a line connecting the light-emitting portion 72 of the photoelectric sensor 70 and the reflector 71. In this case, assuming that the photoelectric sensor 70 is arranged so that the predetermined angle difference θ becomes "0 (zero)°", the light from the light-emitting portion 72 enters in a direction substantially perpendicular to the separated regions 13*c* of the target as indicated by a double-dashed chain line in FIG. 6. Here, when the target to be transported is a non-translucency target, the light is blocked by the separated portions 13*c* and the light-receiving quantity LQ at the light-receiving portion 73 is lowered. As a consequence, it is correctly determined that the separated regions 13*c* exist. However, when the target is a translucent target (for example, a transparent film), when the light from the light-emitting portion 72 enters in the direction substantially perpendicular to the separated regions 13*c*, the light entered in the direction perpendicular to the separated regions 13*c* passes through the separated regions 13*c* without being little changed in direction of travel, and enters the reflector 71. Then, the light reflected from the reflector 71 enters the separated regions 13*c* again in the direction perpendicular thereto. The light entered in the direction perpendicular to the separated regions 13*c* passes through the separated regions 13*c* without being little changed in direction of travel, and received by the light-receiving portion 73 of the photoelectric sensor 70. Consequently, the light-receiving quantity LQ at the light-receiving portion 73 does not become a value smaller than the light-receiving quantity reference value LQth, so that erroneous determination that the separated regions 13*c* are not generated may occur.

At this point, in the embodiment, the photoelectric sensor 70 is arranged so that the above-described predetermined angular difference θ becomes angles different from "0 (zero) °". In other words, the light beam L1 enters the predetermined position P3 of the reflector 71 from the oblique direction. In this case, a probability that the light from the light-emitting portion 72 enters the separated regions 13*c* is increased in comparison with the case where the predetermined angular difference θ is "0(zero)°".

As shown in FIG. 6, the light from the light-emitting portion 72 is capable of entering the separated regions 13*c* easily from the oblique direction. Therefore, even when the target is the translucent target, the direction of travel of the light is changed by the entry of the light from the light-emitting portion 72 into the separated regions 13*c*. Also, part of the light from the light-emitting portion 72 is reflected from the surface of the target. Since such light does not enter the reflector 71, the light is hardly received by the light-receiving portion 73. Even when the light enters the light-receiving portion 73, since the lateral wave component of the light is extremely small, little light is received by the light-receiving portion 73.

Then, little light from the light-emitting portion 72 enters the reflector 71, and hence the light-receiving quantity LQ at the light-receiving portion 73 is remarkably lowered. Consequently, the light-receiving quantity LQ becomes a value smaller than the light-receiving quantity reference value LQth, and it is correctly determined that the separated regions 13*c* are generated in the supported portion 13*b* of the roll paper 13.

Then, when the carriage 52 is still located at the home position HP, the movement of the carriage 52 is prohibited, and the fact that the separated regions 13*c* are generated in the supported portion 13*b* of the roll paper 13 is notified to an operator. Also, when it is determined that the separated portions 13*c* are generated in the course of the movement of the carriage 52 in the direction away from the home position HP, the movement of the carriage 52 is stopped once, and the ejection of ink from the recording head 51 is prohibited and, furthermore, the fact that the separated regions 13*c* are generated is notified to the operator. Subsequently, the carriage 52 is returned to the home position HP. At this time, when the separated regions 13*c* come into contact with the holding portion 55 provided on the lower portion 52*a* of the carriage 52, the separated regions 13*c* are pressed against the supporting surface 41 by the holding portion 55. Therefore, the contact between the carriage 52 returning back to the home position HP and the separated regions 13*c* are restricted by the holding portion 55.

According to the embodiment described above, the following effects are achieved.

(1) In the embodiment, the light-emitting portion 72 arranged at the first position P1 emits light toward the second position P2 set on the carriage 52 on the side opposing the light-emitting portion 72. Therefore, when the separated regions 13*c* generated at the supported portion 13*b* of the roll paper 13 located between the first position P1 and the second position P2, the light-receiving quantity LQ at the light-receiving portion 73 is lowered, and hence it is determined that there exist the separated regions 13*c*. Therefore, accuracy of determination of whether or not at least part of the supported portion 13*b* of the roll paper 13 is separated from the supporting surface 41 is improved.

(2) The roll paper 13 may be deflected also when the transport failure such as the paper jam does not occur. For example, when the above-described cockling phenomenon is occurred, the separated regions 13*c* may be generated on the supported portion 13*b* of the roll paper 13 even though the transport failure does not occur. In the embodiment, in such a case as well, when the separated regions 13*c* of the supported portion 13*b* are located at positions coming into contact with the carriage 52, the fact that the separated regions 13*c* exist can be determined by using the photoelectric sensor 70. In other words, even when the transport failure of the roll paper 13 does not occur, if the separated regions 13*c* are generated in the supported portion 13*b* of the roll paper 13, it is determined that the separated portions 13*c* exist.

(3) When the existence of the separated regions 13*c* is determined by using the photoelectric sensor 70 of the embodiment, the carriage 52 moving in the scanning direction X and the roll paper 13 may be in contact with each other, or the carriage 52 may come into contact with the roll paper 13. In other words, the contact between the carriage 52 and the roll paper 13 may be detected quickly, or a probability of contact between the carriage 52 and the roll paper 13 may be detected.

(4) In the embodiment, the photoelectric sensor 70 is arranged so that the above-described light beam direction intersects with the scanning direction X. Therefore, the probability that the light from the light-emitting portion 72 does not enter the separated regions 13*c* generated in the supported portion 13*b* of the roll paper 13 may be lowered in comparison with the case where the light beam direction is the same direction as the scanning direction X. Therefore, accuracy of determination of whether or not the separated regions 13*c* are generated may be improved.

(5) When the light from the light-emitting portion 72 enters the separated regions 13*c*, the probability that the light from the light-emitting portion 72 enters obliquely the separated regions 13*c* is increased. Therefore, even when the target is the translucent target, the direction of travel of the light is changed by entry of the light from the light-emitting portion 72 into the separated regions 13*c*, so that the light can hardly enter the light-receiving portion 73. Therefore, whether or not the separated regions 13*c* are generated in the supported portion 13*b* is determined irrespective of the type of the target.

(6) In the embodiment, whether or not the separated regions 13*c* are generated in the supported portion 13*b* of the roll paper 13 by using the photoelectric sensor 70 in a stage in which the carriage 52 is located at the home position HP. Therefore, when prohibiting the movement of the carriage 52 on the basis of the detection of the separated regions 13*c*, the contact between the carriage 52 and the roll paper 13 may be avoided.

(7) In the embodiment, whether or not the separated regions 13*c* are generated in the supported portion 13*b* of the roll paper 13 by using the photoelectric sensor 70 in the course of movement of the carriage 52 in the direction away from the home position HP. Therefore, when the carriage 52 and the roll paper 13 are in contact with each other by the generation of the separated regions 13*c*, the movement of the carriage 52 can be stopped quickly. In this case, the degree of breakage of the roll paper 13 may be reduced in comparison with a case where the movement of the carriage 52 in the state of being in contact with the roll paper 13 is continued.

(8) In the embodiment, the photoelectric sensor 70 is arranged so that the above-described light beam direction intersects with the scanning direction X. Depending on the position of the carriage 52, the light from the light-emitting portion 72 may not be received even thought there is no separated region 13*c* in the supported portion 13*b* of the roll paper 13. Accordingly, in the embodiment, the position of the carriage 52 is detected by using the linear encoder 60, and whether or not the determination of the existence of the separated regions 13*c* by using the photoelectric sensor 70 is possible is determined. When the carriage 52 is located at a position which enables the determination of the existence of the separated regions 13*c* by using the photoelectric sensor 70, whether or not the separated regions 13*c* are generated in the supported portion 13*b* of the roll paper 13 by using the photoelectric sensor 70 is determined. In other words, when the carriage 52 is located at a position which allows the light-receiving quantity LQ at the light-receiving portion 73 to be changed depending on whether or not the separated regions 13*c* exist between the first position P1 and the second positions P2, the existence of the separated regions 13*c* may be determined on the basis of the light-receiving quantity LQ at the light-receiving portion 73.

(9) The reflector 71 is provided at the second position P2 of the carriage 52. Therefore, the light-emitting portion 72 or the light-receiving portion 73 needs not to be provided in the carriage 52, and hence a load applied to the carriage 52 is reduced correspondingly.

(10) The first position P1 is set to the downstream side with respect to the second position P2 in the direction of transport Y. Accordingly, whether or not the separated regions 13*c* are generated in a portion of the supported portion 13*b* of the roll paper 13 where the ink is adhered can be determined in comparison with the case where the first position P1 is set to the upstream side with respect to the second position P2 in the direction of transport Y.

(11) The light-emitting portion 72 is arranged so that the light beam L1 enters the predetermined position P3 of the reflector 71 when the carriage 52 is located at the home position HP. Accordingly, the fact that the separated regions 13*c* exist in the supported portion 13*b* of the roll paper 13 can be detected in a stage in which the carriage 52 is located at a position far from the first position P1 in comparison with the case where the mode of arrangement of the light-emitting portion 72 is set on the basis of a case where the carriage 52 is located at a position close to the first position P1. In other words, the separated regions 13*c* may be detected in an early stage, and hence the contact between the carriage 52 and the roll paper 13 may be detected quickly, or the contact between the carriage 52 and the roll paper 13 may be avoided, correspondingly.

(12) The holding portion 55 is provided on the lower portion 52*a* of the carriage 52 on the right side of the recording head 51. Therefore, when the separated regions 13*c* are generated in the supported portion 13*b* of the roll paper 13 after the carriage 52 has moved in the direction away from the home position HP, the separated regions 13*c* are pressed against the supporting surface 41 by the holding portion 55 of the carriage 52 moving toward the home position HP. Therefore, the contact between the carriage 52 and the roll paper 13 may be inhibited.

The embodiment described above may be modified as follows.

In the embodiment, the carriage 52 may not be provided with the holding portion 55. In this case, a configuration in which the reflector is provided also on the right side of the carriage 52, and the photoelectric sensor may be provided on the right side of the movable area 54 is also applicable. In this case, whether or not the separated regions 13*c* are generated in the supported portion 13*b* of the roll paper 13 may be determined even when the carriage 52 is moved in the direction toward the home position HP.

In the embodiment, the predetermined position P3 may be set on the upstream side in the direction of transport Y with respect to the same position in the fore-and-aft direction with respect to the center of the recording head 51 in the fore-and-aft direction. In this configuration, the moved amount reference value MCth may be set to a large value in comparison with the case where the predetermined position P3 is set to the same position in the fore-and-aft direction as the center of the recording head 51 in the fore-and-aft direction. In other words, an area which allows determination of the existence of the separated portions 13*c* by using the photoelectric sensor 70 is increased.

In the embodiment, the first position P1 may be set at the same position as the second position P2 in the vertical direction, and may be set below the second position P2 in the vertical direction.

In the embodiment, the first position P1 may be set to the upstream side with respect to the second position P2 in the direction of transport Y.

The first position P1 may be set at the same position as the second position P2 in the direction of transport Y. In this case, the light beam direction described above matches the scanning direction X.

In the embodiment, the reflector 71 may not be provided. In this case, it is preferable that a light-emitting sensor (for example, a laser diode) as a light-emitting portion is arranged on one of the first position P1 and the second position P2, and a light-receiving sensor (a photo detector) is arranged on the other one of the first position P1 and the second position P2. In this case, a light-detecting unit is composed of the light-emitting sensor and the light-receiving sensor.

In the embodiment, a configuration in which the photoelectric sensor 70 is provided at the second position P2 of the carriage 52 and the reflector 71 is provided at the first position P1 is also applicable.

In this embodiment, a configuration in which the upward separation determination process routine is performed only in a case where the carriage 52 is located at the home position HP is also applicable. In this case, the respective processes of Steps S10 and S11 may be omitted.

In this embodiment, a configuration in which the upward separation determination process routine is performed only in a case where the carriage 52 is moved away from the home position HP is also applicable.

In the embodiment, the rotary encoder may be provided at the output shaft of the carriage motor 53 instead of the linear encoder 60. In this case, the rotary encoder functions as the moved amount detecting unit.

In the embodiment, a configuration in which the supporting base 40 is not provided with the sucking mechanism 44 and the sucking holes 42 is also applicable.

In the embodiment, the supporting unit configured to support the target may also be provided with the supporting base moving in the direction of transport in the state of supporting a supporting belt for supporting the supported portion and the target.

In the embodiment, the liquid ejecting head to be mounted on the carriage 52 may be a head configured to eject overcoat fluid (liquid) on the printed paper.

In the embodiment, the ink ejecting unit 15 may be an ink ejecting unit of, so-called, a lateral scan type in which the scanning direction X of the carriage 52 matches the direction of transport Y. In this case, a plurality of the recording heads 51 may be arranged in a staggered pattern so as to eject ink to the entire area in the width direction of the target. The carriage 52 may be provided with an elongated recoding head extending along the width direction of the target.

In the embodiment, the target may be targets the than the roll paper 13 (for example, cut paper, cloth, film and the like).

In the embodiment, a processing unit configured to perform processing other than the printing process may be provided on the downstream side with respect to the ink ejecting unit 15 in the direction of transport Y. Then, the processing unit may be provided with the supporting base configured to support the target, the moving body configured to move along the predetermined scanning direction, and a light-detecting unit having the light-emitting portion 72 and the light-receiving portion 73. In this configuration, in the processing unit, when the separated region is generated in the target, the separated region may be detected.

In the embodiment, the light-detecting unit including the light-emitting portion 72 and the light-receiving portion 73 may be provided on the upstream side with respect to the ink ejecting unit 15 in the direction of transport Y. In this case, the light-emitting portion 72 and the light-receiving portion 73 may be arranged on the outside of the supported portion of the target supported by the supporting base in the width direction of the target.

In this configuration, the separated regions of the target may be detected by using the light detecting unit on the upstream side with respect to the ink ejecting unit 15 in the direction of transport Y.

The moving body of the processing unit may be provided with an image pickup unit such as a camera configured to pick up an image of a surface of the target on which the ink is ejected. In this case, a printing failure in the ink ejecting unit 15 may be detected by using the image pickup unit provided on the moving body.

When the ink used in the ink ejecting unit 15 is ultraviolet cure ink, the moving body of the processing unit may be provided with an irradiating device configured to irradiate ultraviolet ray on the surface of the target on which the ink is ejected.

In a case where the processing unit is provided on the downstream side with respect to the ink ejecting unit 15 in the direction of transport Y, the carriage provided in the ink ejecting unit 15 may not be moved when the ink is ejected. In this case, the carriage may be arranged on the area above the supporting base 40, and the carriage may be provided with a plurality of the recording heads 51 arranged in the staggered pattern so that the ink is ejected in the entire area of the target in the width direction. The carriage may be provided with the elongated recording head extending along the width direction of the target.

In the embodiment, the liquid ejecting apparatus is embodied in the form of the ink jet printer 11. However, a liquid ejecting apparatus which ejects or discharges liquid other than ink may also be employed. The liquid ejecting apparatus of the embodiment may be applied to various liquid ejecting apparatuses including a liquid ejecting head for discharging a minute amount of liquid drops. The term "liquid drops" indicates a state of liquid discharged from the liquid ejecting apparatus, and includes a particle state, a tear drop state, and a thready state. The term "liquid" here may be any material as long as the liquid ejecting apparatus is capable of ejecting. For example, it may be a substance in a state of liquid phase, and includes not only a liquid state substance having a high or low viscosity, fluid state substance such as inorganic solvent such as sol and gel water, organic solvent, solution, a liquid state resin, a liquid state metal (melted metal), or liquid as a state of the substance, but also those obtained by dissolving, dispersing or mixing particles of functional material formed of solid state substance such as pigment or metal particles solvent. Representative examples of the liquid include ink as described in the embodiment and a liquid crystal. The term "ink" here includes various liquid compositions such as general water-based ink, oil-based ink, gel ink, and hot-melt ink. Detailed examples of the liquid ejecting apparatus include liquid ejecting apparatuses which ejects liquid containing materials such as electrode material or colorant in the form of dispersion or dissolution used for manufacturing liquid crystal displays, EL (electroluminescence) displays, surface emission-type displays, or color filters, liquid ejecting apparatuses which eject a biological organic substance used for manufacturing biochips, liquid ejecting apparatuses which are used as accurate pipettes and eject liquid as a sample, text printing apparatuses, or micro-dispensers. Furthermore, liquid ejecting apparatuses configured to eject lubricant for pinpoint lubrication for precise machines such as watches or cameras, liquid ejecting apparatuses configured to eject transparent resin liquid such as a UV-cured resin or the like on a substrate for forming a micro-semispherical lens (optical lens) used for optical communication elements or the like, and a liquid ejecting apparatus for ejecting etching liquid such as acid or alkali for etching the substrate or the like may be employed. The invention may be applied to any one of the liquid ejecting apparatuses.

In the embodiment, a recording unit provided with a recording head of a wire impact system, a thermal transfer system, or an electrophotographic system may be provided instead of the ink ejecting unit 15.

Added below is a technical thought which can be figured out from the embodiment and other embodiments.

(i) A recording apparatus including:

a recording head configured to perform recording on a target transported along a direction of transport;

a supporting unit configured to support the target;

a moving body configured to move forward and backward in a movable area set so that a transporting route for the target is located between the supporting unit and the movable area along a scanning direction in a prescribed direction in which the supporting unit and the target supported by the supporting unit are arranged when the supporting unit supports the target;

a light detecting unit arranged so that the transporting route is located between the supporting unit and the light-detecting unit in the prescribed direction, and including a light-emitting portion configured to emit light and a light-receiving portion configured to receive light from the light-emitting portion; and a determining unit configured to determine whether or not at least part of the supported portion of the target supported by the supporting unit is separated from the supporting unit on the basis of the light-receiving quantity at the light-receiving portion wherein the light-emitting portion is arranged at a first position set out of the movable area and a second position set at one end portion of the moving body in the scanning direction, and the light-emitting portion arranged at one of the first and second positions emits light toward the other one of the first and second positions.

What is claimed is:

1. A liquid ejecting apparatus comprising:

a liquid ejecting head configured to eject liquid with respect to a target transported along a direction of transport;

a supporting unit configured to support the target;

a moving body configured to move forward and backward in a movable area set so that a transporting route for the target is located between the supporting unit and the movable area along the direction of scanning in a prescribed direction in which the supporting unit and the target supported by the supporting unit are arranged when the supporting unit supports the target;

a light-emitting portion configured to emit light traversing the supporting unit in an area above the supporting unit;

a light-receiving portion configured to receive light from the light emitting portion; and a determining unit configured to determine whether or not at least part of a supported portion of the target supported by the supporting unit is separated from the supporting unit on the basis of the light-receiving quantity at the light-receiving portion, wherein a reference position of the moving body is set to one side with respect to the supported portion of the target supported by the supporting unit in the width direction of the target, and the light-emitting portion is set to the other side with respect to the supported portion of the target in the width direction of the target, and the determining unit determines whether or not at least part of the supported portion of the target is separated from the supporting unit on the basis of the light-receiving quantity at the light-receiving portion in one of cases where the moving body is located at the reference position, and where the moving body moves in the direction away from the reference position.

2. The liquid ejecting apparatus according to claim 1, wherein the light-emitting portion is set to a position at which the scanning direction of the moving body and the direction of travel of the light emitted from the light-emitting portion intersects.

3. The liquid ejecting apparatus according to claim 1, further comprising:

a moved amount detecting unit configured to detect the moved mount of the moving body in the scanning direction with reference to the reference position, wherein when the moved amount detected by the moved amount detecting unit is equal to or lower than a moved amount reference value set in advance, the determining unit determines whether or not at least part of the supported portion is separated from the supporting unit on the basis of the light-receiving quantity at the light-receiving portion.

4. The liquid ejecting apparatus according to claim 3, further comprising a reflecting portion, wherein the light-receiving portion is capable of receiving the reflected light from the reflecting portion when the moved amount detected by the moved amount detecting unit is equal to or lower than the moved amount reference value.

5. The liquid ejecting apparatus according to claim 1, wherein the light-emitting portion is arranged so that the light travels toward a predetermined position of the moving body located at the reference position or the upstream side with respect to the predetermined position thereof in the direction of transport.

* * * * *